US005875715A

United States Patent [19]

Hamisch, Jr. et al.

[11] Patent Number: 5,875,715

[45] Date of Patent: Mar. 2, 1999

[54] HAND-HELD LABELER

[75] Inventors: Paul H. Hamisch, Jr., Franklin; James A. Makley, Springboro, both of Ohio

[73] Assignee: Monarch Marking Systems, Inc., Dayton, Ohio

[21] Appl. No.: 667,039

[22] Filed: Jun. 19, 1996

[51] Int. Cl.[6] ..... B41F 1/08

[52] U.S. Cl. ..... 101/288; 101/287; 156/584

[58] Field of Search ..... 101/287, 288, 101/291, 348; 156/384, 584, 577, 579

[56] References Cited

U.S. PATENT DOCUMENTS 3,330,207 7/1967 De Man .
4,116,747 9/1978 Hamisch, Jr. .
4,352,710 10/1982 Makley ..... 101/288
4,813,355 3/1989 Stork ..... 101/288

*Primary Examiner*—John Hilten
*Attorney, Agent, or Firm*—Joseph J. Grass

[57] ABSTRACT

There is disclosed a hand-held labeler which can feed and apply a relatively long label or tape to merchandise or packaging. In one embodiment the feeding of the label web is accomplished by using a feed wheel that is driven both during the feeding stroke of a manual actuator and during its return stroke. The print head is driven toward and away from a platen during each cycle and the advance of the feed wheel is interrupted as the print head nears printing cooperation with the platen and the intervening label. In another embodiment some of the advance of the feed wheel is through a one way clutch.

25 Claims, 6 Drawing Sheets

FIG-6
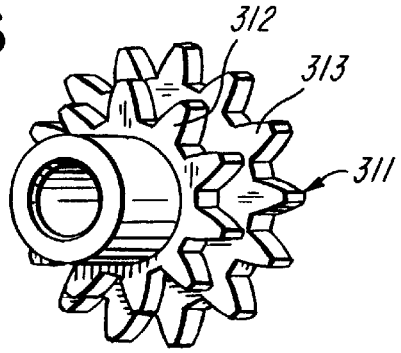
FIG-7
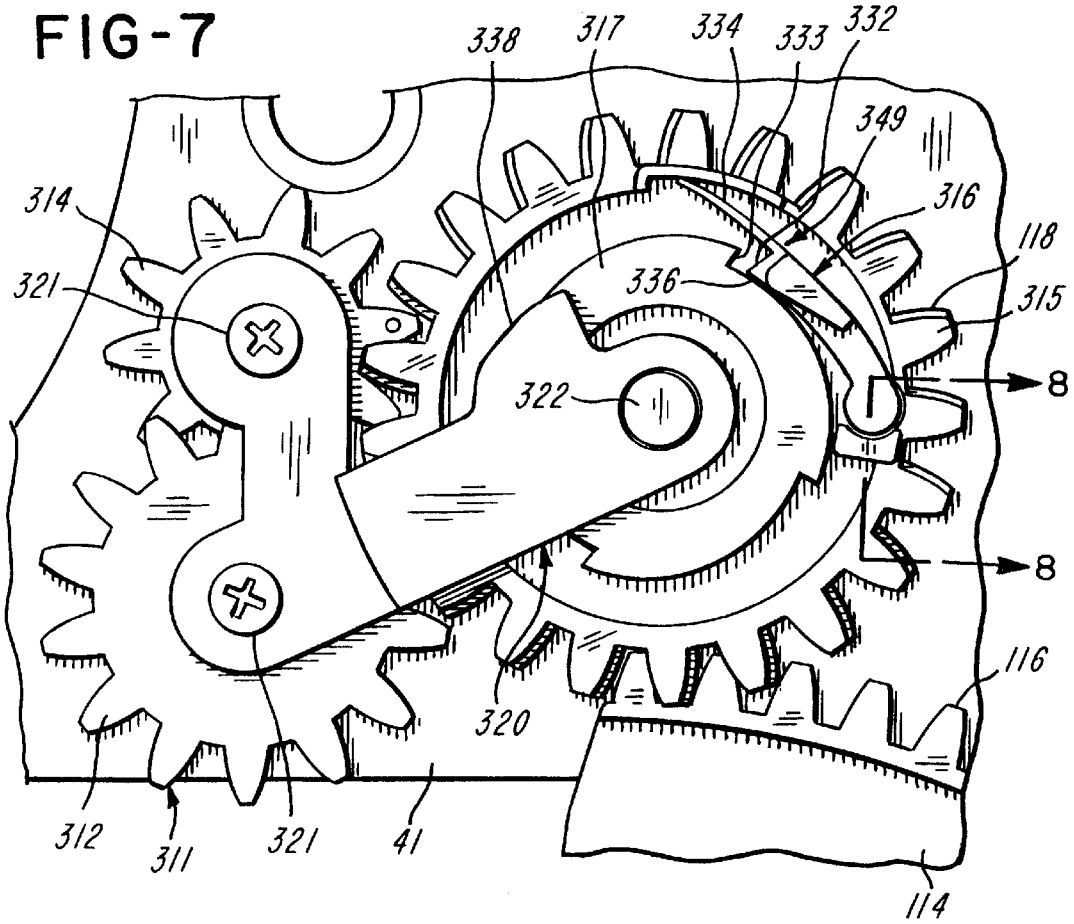
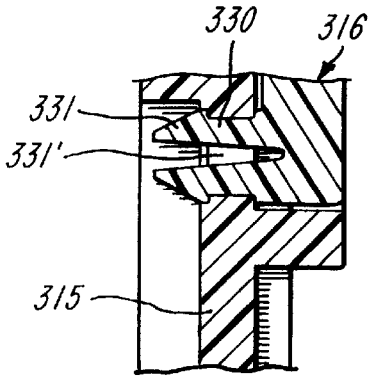
FIG-8

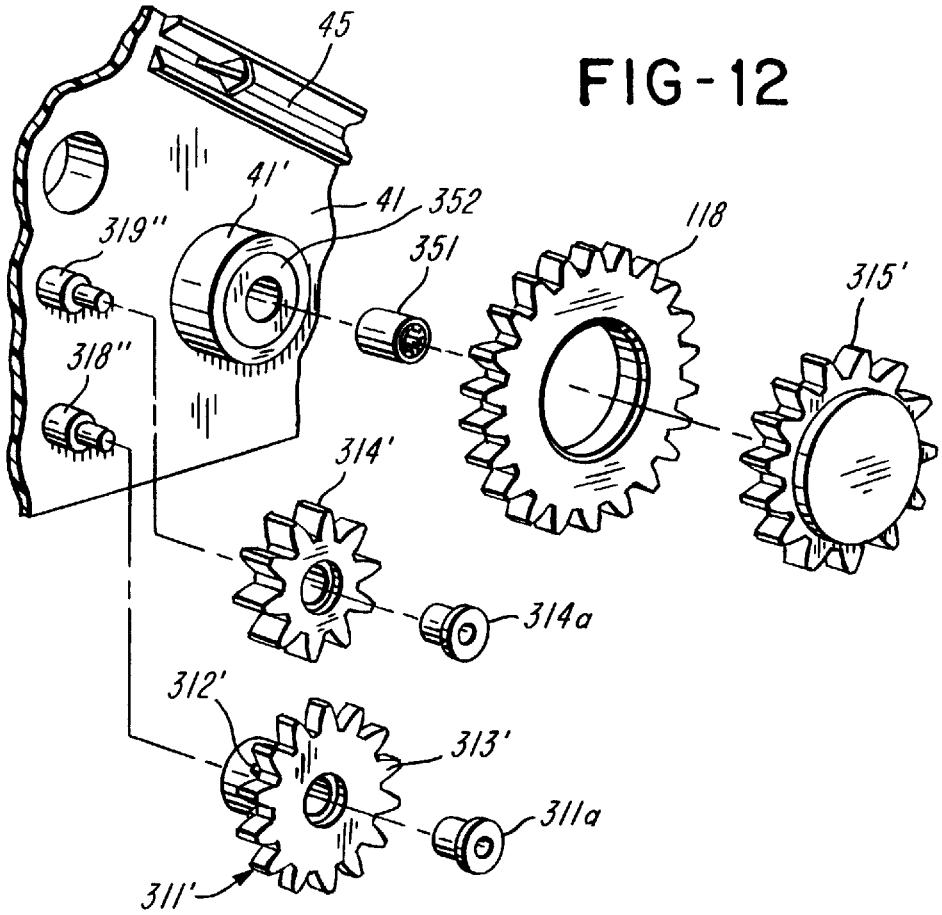
FIG-12
FIG-13
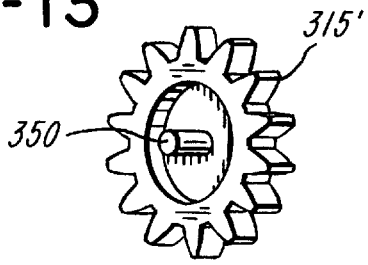

HAND-HELD LABELER

BACKGROUND OF THE INVENTION

1. Field of the Invention

This invention relates to the art of hand-held labelers.

1. Brief Description of the Prior Art

The following U.S. patents are made of record: U.S. Pat. No. 3,330,207 to DeMan granted Jul. 11, 1967 and U.S. Pat. No. 4,116,747 to Hamisch, Jr. granted Sep. 26, 1978.

SUMMARY OF THE INVENTION

This invention relates to an improved hand-held labeler capable of feeding a relatively long label.

In accordance with one embodiment of the invention, there is provided a hand held labeler for printing and applying pressure sensitive labels. The labeler has a housing which mounts a platen and a cooperable print head. The print head moves toward and away from the platen to effect printing. A manually operable actuator is disposed at a handle of the housing. When the actuator is moved in one direction, the print head is moved toward the platen and a feed wheel is advanced to advance a label carrying web. When the actuator moves in the opposite direction, the print head moves away from the platen and the feed wheel is advanced further to further advance the label carrying web. The advance of the web is caused by a first pawl and ratchet mechanism coupled to the feed wheel and the further advance is caused by a second pawl and ratchet mechanism. As the print head nears printing cooperation with the platen, the first pawl and ratchet mechanism is rendered ineffective. This causes the advance of the feed wheel to be interrupted to avoid the possibility of smearing the printing when the print head cooperates with the platen to print on an intervening label.

In another embodiment there is provided a one-way clutch for driving the feed wheel as the print head is moving toward the platen.

In both disclosed embodiments, the gearing is tailored to the desired length of advance of label carrying web during each cycle of operation. It is preferred that the print head be mounted for straight line movement and that the actuator oscillate in one direction and in a direction opposite to the one direction.

BRIEF DESCRIPTION OF THE DRAWINGS

FIG. 6 is a perspective view of a compound gear shown in FIGS. 2, 3 and 4;

FIG. 7 is a side elevational view of gearing also shown in FIGS. 3 and 4;

FIG. 8 is a sectional view taken along 8—8 of FIG. 7;

FIG. 12 is a fragmentary, exploded, perspective view of an alternative embodiment of the labeler; and FIG. 13 is a perspective view of one of the gears shown in FIG. 12.

DETAILED DESCRIPTION OF THE PREFERRED EMBODIMENTS

Figure 1:
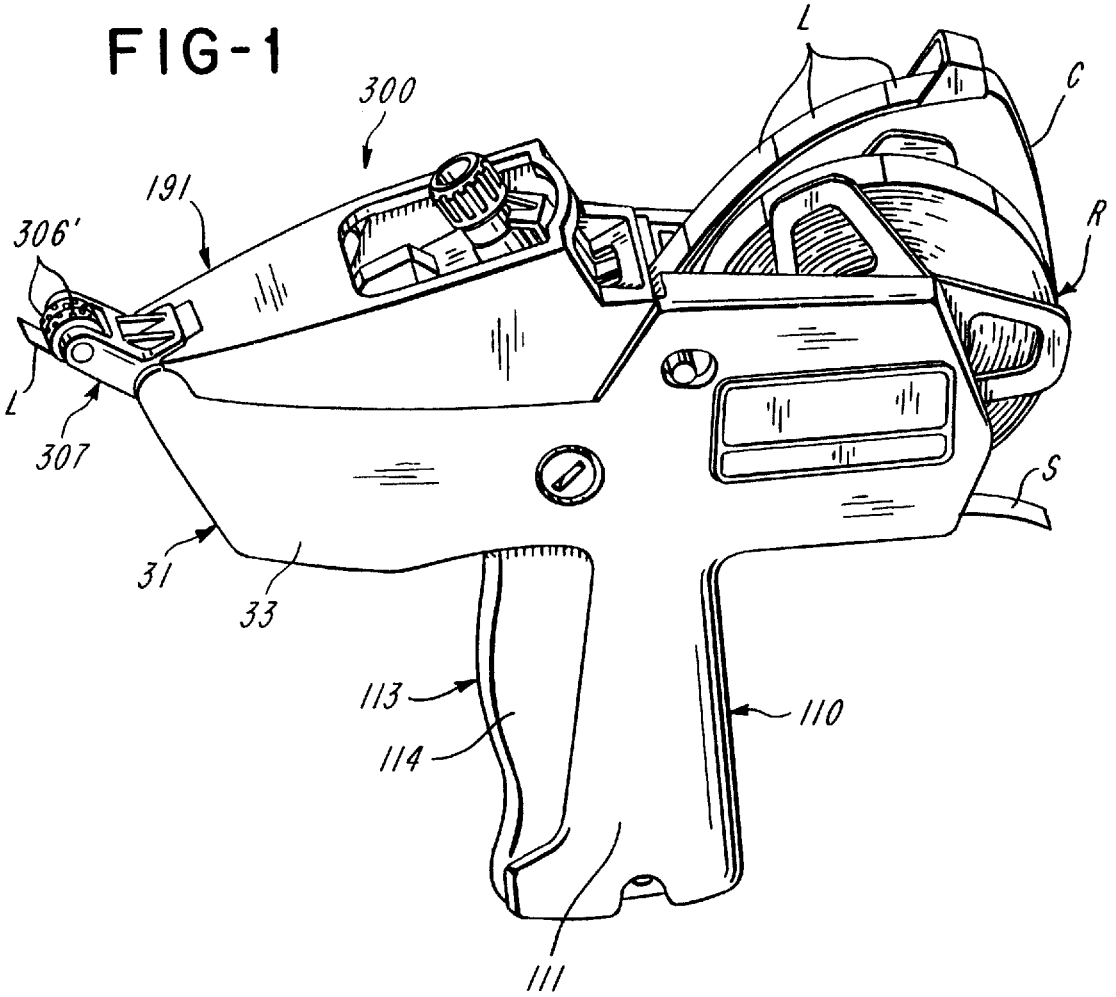
FIG. 1 is a perspective view of a hand-held labeler of the invention equipped with a roll of labels.

The present application relates to improvements over a hand held labeler depicted in U.S. Pat. No. 4,116,747 of Paul H. Hamisch, Jr. assigned to Monarch Marking Systems, Inc. While retaining the essential structure, function and arrangement of parts of the labeler depicted in U.S. Pat. No. 4,116,747, but adding the improvements shown and described in the present application, applicants have been able to print and apply labels of substantially greater length. Accordingly, U.S. Pat. No. 4,116,747 is incorporated herein by reference and this patent may be referred to for further details. In instances which components of the present invention are the same or essentially the same as components in U.S. Pat. No. 4,116,747, the same reference characters are used.

With reference to FIG. 1 of the present application, there is shown a labeler 300 having a housing or frame 31. The housing 31 supports a roll R of a composite label web C of pressure sensitive labels L. The labels L are releasably adhered to the supporting material or carrier web S. The housing 31 is shown to have a handle 111 at which an actuator 113 in the form of a lever 114 is pivotally mounted. An applicator assembly or applicator head 307 which includes an applicator 306 in the form of a pair of rolls 306' is disposed at the front end portion of the housing 31 of the labeler 300. If desired, the applicator 306 can be made of a one-piece roll which is twice as wide as one of the rolls 306', and as such would be easier to assemble onto the applicator head 307.

Figure 2:
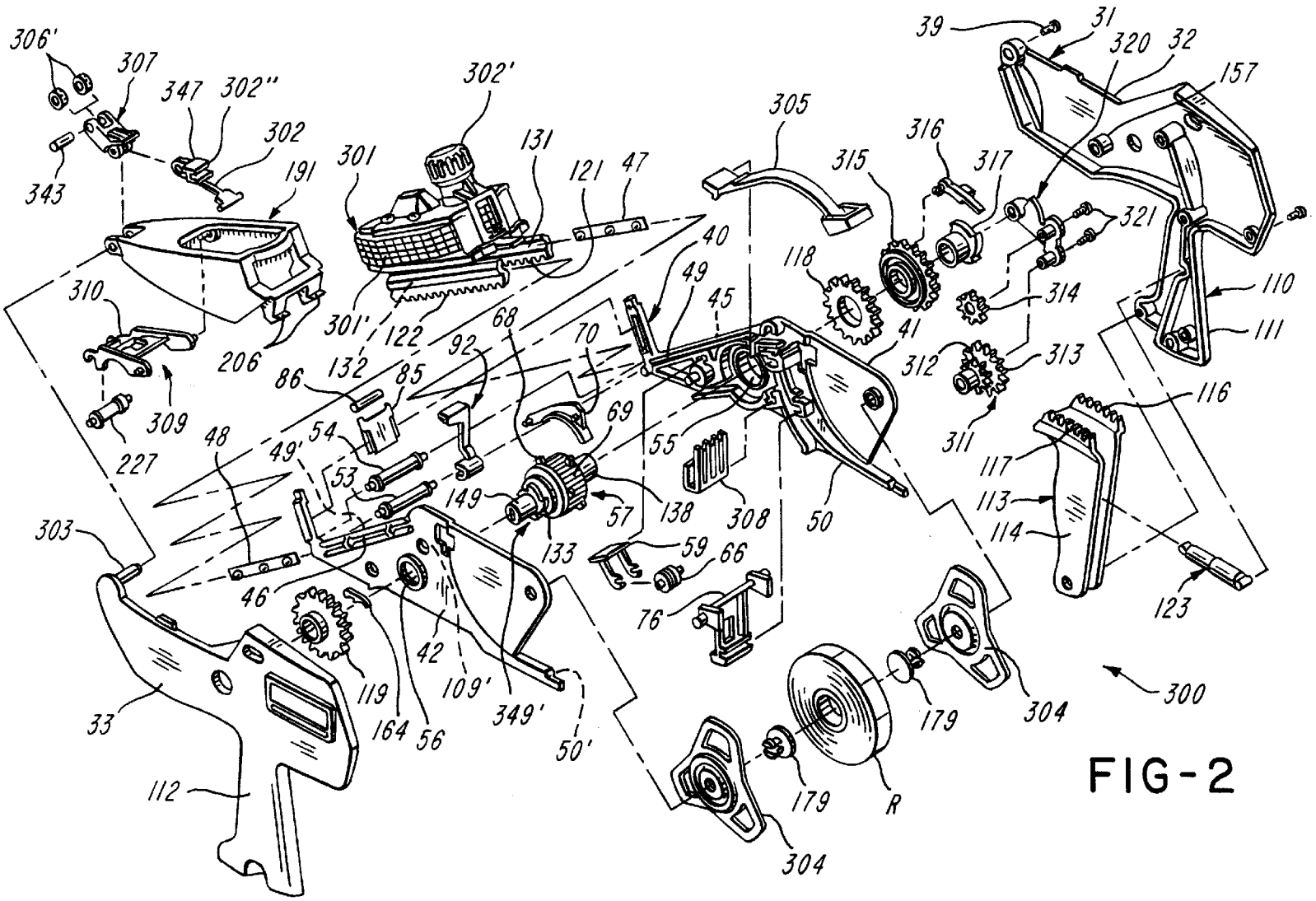
FIG. 2 is an exploded perspective view of the labeler shown in FIG. 1.

With reference to FIG. 2, there is shown the labeler 300 with its housing 31 which includes frame or housing sections 32 and 33. The housing section 33 has a post 303 connected to the housing section 32 by a screw 39. The housing 31 mounts a subframe 40 comprised of substantially mirror image subframe sections 41 and 42. The subframe sections 41 and 42 have ball tracks 45 and 46. A print head 301 has a pair of opposed ball tracks 131 and 132. A ball bearing strip 47 is received between tracks 45 and 131 and a ball bearing strip 48 is received between tracks 46 and 132 to guide the print head 301 for straight line movement on the subframe 40. Straight line movement of the print head 301 is preferred as it produces the best printing, as compared, for example, with pivotal movement of the print head. The print head 301 has a set of printing members 301' which are selectively movable by a selector 302'.

There is a feed wheel assembly 57 which includes a feed wheel 69 having teeth 68 to which a ratchet wheel 133 is coupled. The teeth 68 are arranged in a staggered pattern and engage staggered feed slits or holes in the carrier web S. The ratchet wheel 133 cooperates with a pawl 164 to provide a pawl and ratchet mechanism 349'. The pawl 164 is pivotally mounted on a second gear 119. A first gear 118 meshes with a first gear section 116 and a first rack 121. The gear 119 meshes with a second gear section 117 and a second rack 122. The gear I 19 rotates on a tubular portion 149 and the gear 118 rotates on a collar 41' formed integrally with subframe section 41. The lever 114 is pivoted at its lower end portion to the lower end portion of the handle 110. A resilient device 123 urges the actuator 113 counterclockwise as shown in FIG. 2.

The label roll R is mounted in the hub members 304 and 305 which are mounted to respective subframe sections 41 and 42 by means of retainers 179. The composite label web C passes from the roll R over and through a resilient device 305 secured to the subframe sections 41 and 42. From there the web C passes partly around a roller 54 and over the platen 85. The composite web C passes beneath a hold down and guide member 92. The carrier web S makes a sharp bend about the delaminator 86 and the label L (shown in phantom lines in FIG. 11) passes into underlying relationship to an applicator head 307. From there the carrier web S passes about the roller 53 and passes between die roller 66 and the feed wheel 69. As shown, the die roller 66 is rotatably mounted by a holder 59. A stripper 308 secured to the subframe 40 strips the advancing carrier web S from the feed wheel 69.

Movable housing section or cover 191 is pivotally mounted on the post 34. The cover 191 has shoulders 206 which latch with the latch 76. A guide plate 70 is adjacent the feed wheel 69 and the stripper 308.

The cover 191 carries an inking mechanism 309 comprised of a pivotal member 310 and an ink roller 227.

Turning to the improvement which enables the labeler 300 to feed long labels L, there is shown in FIG. 2 an integrated molded compound gear generally indicated at 311 which includes a small gear 312 and a larger gear 313. A gear 314 meshes with the gear 118 and gear 312. The gear 313 meshes with a gear 315. The gear 315 pivotally mounts a pawl 316 which cooperates with a ratchet in the form of a ratchet wheel 317. The ratchet wheel 317 is coupled to the feed wheel 69.

Figure 3:
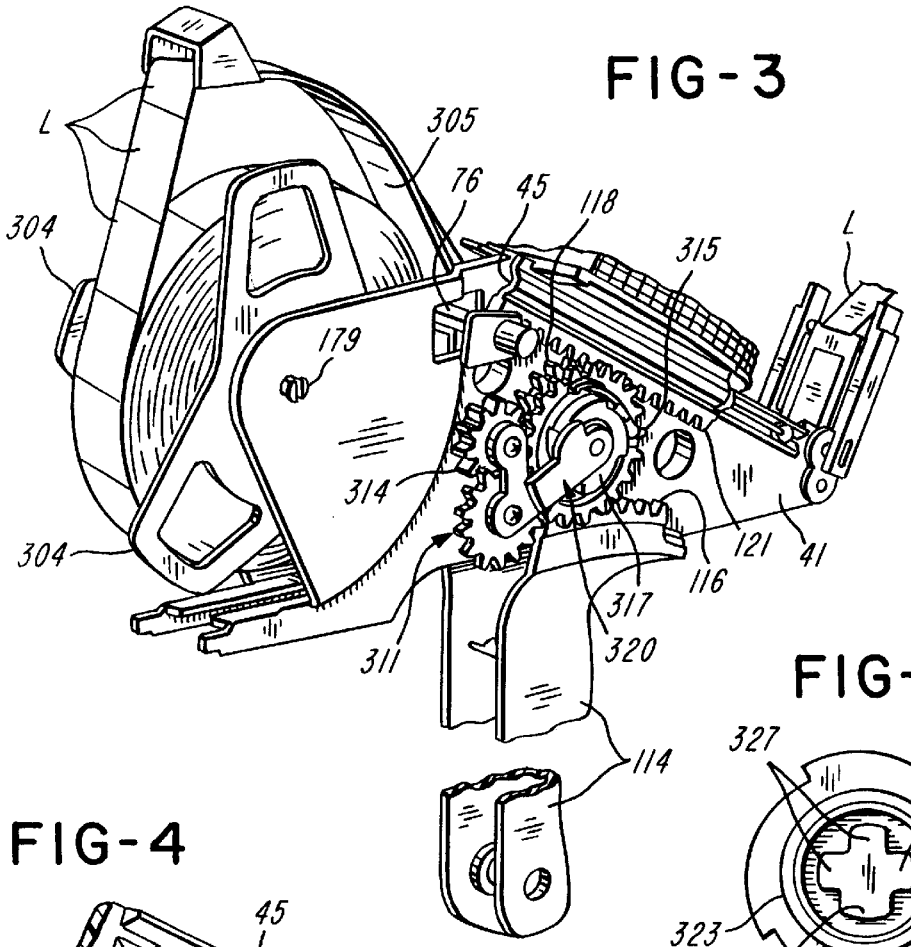
FIG. 3 is a fragmentary perspective view showing a portion of the labeler and the label roll.
Figure 5:
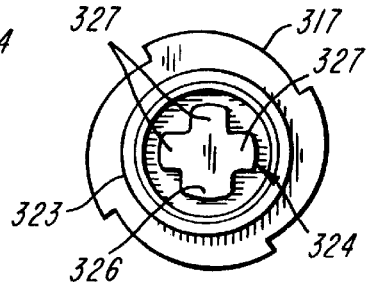
FIG. 5 is a perspective view of a ratchet wheel shown in FIGS. 3 and 4.
Figure 4:
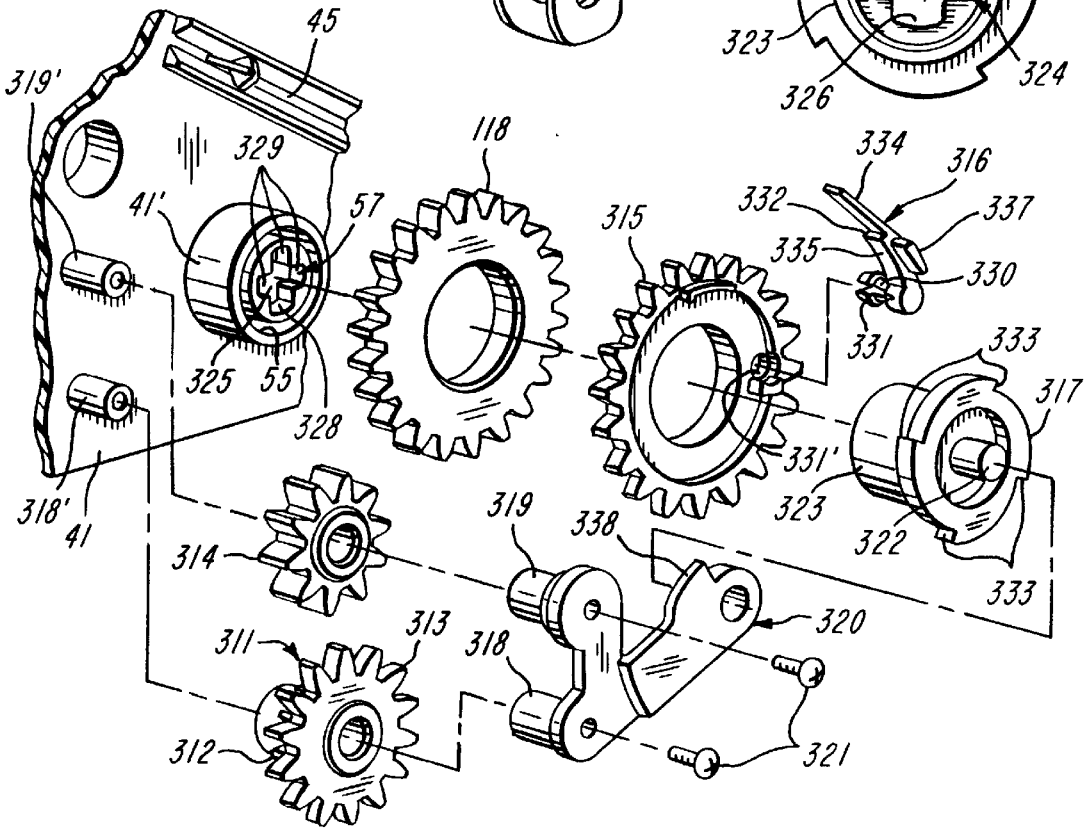
FIG. 4 is a fragmentary, exploded, perspective view of some of the components shown in FIG. 3.

As shown in FIGS. 2, 3 and 4, the gears 311 and 314 are rotatably mounted on respective tubular members 318 and 319 of a bracket 320. The tubular members 318 and 319 receive respective studs 318' and 319' on the subframe section 41. Screws 321 threadably received by the studs 318' and 319' hold the bracket 320 in position. The ratchet wheel 317 has an integral tubular sleeve 323. The gears 118 and 315 are rotatably mounted on the collar 41'. As shown in FIG. 5, there is an integrally formed cross-shaped member 324 coaxially of the ratchet wheel 317 and the sleeve 323. The member 324 is received in a cross-shaped hole 325, and thus the ratchet wheel 317 and the feed wheel assembly 57 are coupled. One arm 326 of the member 324 is large and three arms 327 are small. Likewise, one pocket or recess 328 is large and three pockets or recesses 329 are small. The arm 326 is received in the pocket 328 and the arms 327 are received in the pockets 329. Thus, the ratchet wheel 317 is keyed to the feed wheel assembly in one and only one angular position, so that the feed wheel assembly 57 and the ratchet wheel 317 are always in their proper orientation with respect to each other.

The pawl 316 is pivotally mounted to the gear 315 as best shown in FIGS. 4 and 8. The pawl 316 has a split projection 330 and a head 331. Once the head 331 is snapped into a hole 331' in the gear 315, the pawl 316 is captive but can pivot in the hole 331'.

As shown in FIG. 7, the pawl 316 has a tooth 332 cooperable with one of the four teeth 333 of the ratchet wheel 317. The pawl 316 has an integrally formed leaf spring 334 which normally urges a side of surface 335 of the tooth 332 against the outer surface 336 of the ratchet wheel 317. As the gear 315 rotates counterclockwise as seen in FIG. 7, the pawl 316 which the gear 315 carries also moves counterclockwise until its tooth 332 engages the tooth 333 on the ratchet wheel 317. Continued counterclockwise rotation of the gear 315 and the pawl 316 causes the ratchet wheel 317 to be driven counterclockwise. The pawl 316 has an integrally formed cam follower 337 which cooperates with a cam surface 338 on the bracket 320 when the pawl 316 has driven the ratchet wheel 317 through a predetermined angle so that the tooth 332 on the pawl 316 moves radially outwardly and out of driving contact with the tooth 333 on the ratchet wheel 317. When this drive connection between the pawl 316 and the ratchet wheel 317 ceases to exist, the ratchet wheel 317 ceases to rotate even though the counterclockwise rotation of the gear 315 and the pawl 316 continues. It should be noted that when the user operates the actuator 11 3, the gear sections 11 6 and 117 drive the gears 118 and 119 which in turn drive the racks 121 and 122 with which the print head 301 is connected. Thus, the actuator 113 moves upon complete actuation of the actuator 113 until the print head 301 is in printing cooperation with the platen 85. The cam follower 337 and the cam surface 338 are constructed so that the tooth 332 loses its drive connection with the tooth 333 as the print head 301 is nearing and continues to move to the printing cooperation with the platen 85 and the intervening label L, but before such printing cooperation occurs. This prevents smearing of the printing which may occur if advance of the feed wheel 69 continues up to such printing cooperation. As the actuator 113 is operated in one direction, referred to herein as a first direction, to move the print head 301 in a first direction toward the platen 85, the gear 119 brings the pawl 164 pivotally mounted on the gear 119 into a ready position. When the user releases the actuator 113, the resilient device 123 acts on the actuator 113 to move the actuator 113 in the opposite direction, which can be referred to as a second direction. This causes the gears 118 and 119 to rotate to move the print head 301 in a second or return direction. During such return movement of the actuator 113 and the print head 301, the gear 119 causes the pawl 164 to cooperate with the ratchet wheel 133 to resume advance of the feed wheel 69 and to further advance the carrier web S. During the return movement, the gears 118, 312, 313, 314 and 315 return to their initial positions, and the pawl 316 returns to its initial position ready to engage the next tooth 333 on the ratchet wheel during the next cycle.

Figure 9:
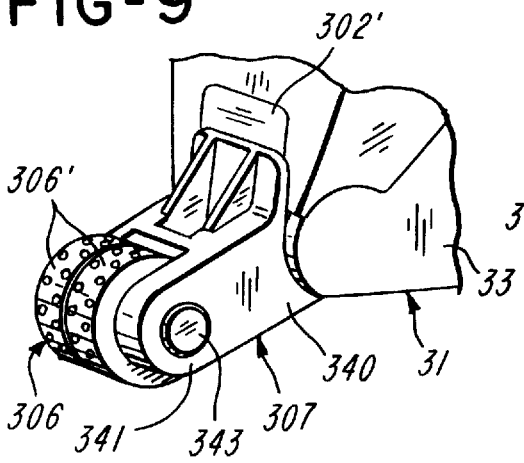
FIG. 9 is a perspective view of an applicator assembly at a front end portion of the labeler.
Figure 10:
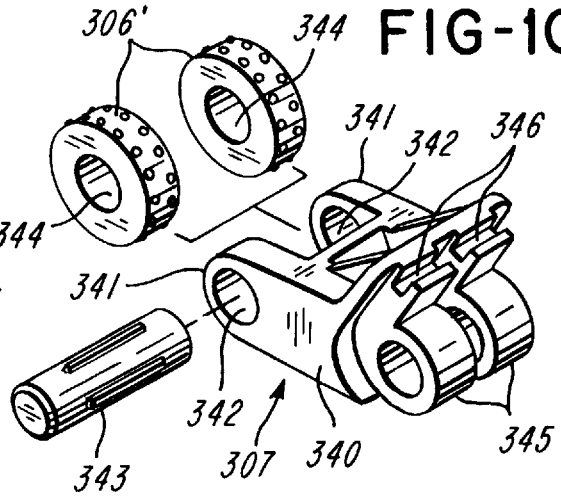
FIG. 10 is an exploded perspective view of the applicator assembly also shown in FIGS. 1, 2 and 9.
Figure 11:
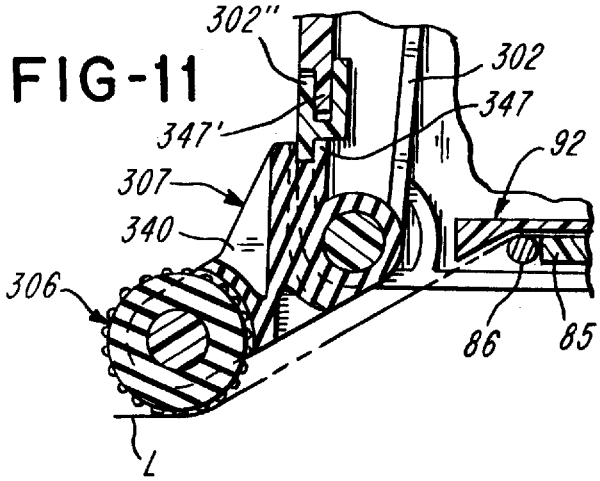
FIG. 11 is a sectional view showing the applicator assembly mounted at the front end portion of the labeler.

With reference to FIGS. 9, 10 and 11, the applicator head 307 is shown to include a molded body 340 having a pair of spaced arms 341 with aligned holes 342. The body 340 is preferably composed of a material which is somewhat flexible and resilient to withstand impact when the labels are being applied to merchandise, and when the labeler 300 is dropped. A suitable material is a urethane. A pin 343 press fitted into the holes 342 extends through holes 344 in the applicator rolls 306' of the applicator 306. The arms 341 thus straddle the applicator rolls 306'. The pin 343 rotatably mounts the applicator rolls 306'. The body 340 also have a pair of spaced arms 345 which receive the post 303. The body 340 also has U-shaped aligned grooves 346 which capture a tongue 347 on the inker spring 302. The inker spring 302 has a forked end 302" which captures a tongue 347' on the housing 31. As shown, the applicator head 307 is cantilevered to the frame 31. This assures that the applicator 306 is sufficiently far from the peel roller 86 to be able to apply a long label L.

With reference to FIGS. 12 and 13, there is disclosed an alternative embodiment which is identical to the embodiment of FIG. 1 through 11 except as described below. Like reference characters are used for parts that has the same construction, function and relative locations as parts in the embodiment of FIGS. 1 through 11. In the embodiment of FIGS. 12 and 13, gear 314' and gears 312' and 313' of a compound gear 311' are identical to the respective gears 314, 312 and 313 except that the gear 314' and the compound gear 313' have stepped inside diameters and are mounted on stepped posts 318" and 319" and bushings 311*a* and 314*a*. The housing section 32 is close enough to the gears 311' and 314' so that the gears 311' and 314' do not shift axially on the posts 318" and 319". The gear 314' meshes with the gear 118 and with the gear 312'. The gear 313' meshes with the gear 315'. The gear 315' has an integral shaft 350 received by a one-way clutch 351. The gear 315' can rotate in one direction (clockwise as viewed in FIG. 12) without imparting any motion to the feed wheel assembly 57, but the clutch 351 clutches to the shaft 350 when the gear 315 rotates counterclockwise to drive the feed wheel assembly 57 to advance the web C. The one-way clutch 351 is received in a tubular end portion 352 of the feed wheel assembly 57. The gears 118 and 315' rotate on the collar 41'. When the actuator 113 is released, the pawl 164 and the ratchet 133 further advance the carrier web S as explained with respect to the embodiment of FIGS. 1 through 11, and also the gears 314', 312', 313' and 315' return to their initial positions as permitted by the one-way clutch 351.

The gears 311, 3 14 and 315 in the one embodiment and the gears 311', 314' and 315' in the other embodiment are considered to constitute gearing. The pawl 316 and the ratchet wheel 317 are considered to be the pawl and ratchet mechanism 349. The gear section 116, the gear 118, the set of gears 312, 313, 314 and 315, the pawl 316 and the ratchet 317 is considered to be a drive connection. The gear section 117, the gear 119, the pawl 164 and the ratchet 153 is considered to be a drive connection.

Although the invention is disclosed in connection with a labeler that both prints and applies labels, it can be used in connection with a labeler or applicator which only applies, but does not print, labels.

The expression "label" as used in this application is intended to include tape.

Other embodiments or modifications of the invention will suggest themselves to those skilled in the art, and all such of these as come within the spirit of this invention are included within its scope as best defined by the appended claims.

We claim:

1. A hand-held labeler for printing and applying pressure sensitive labels, comprising: a housing having a manually graspable handle, means on the housing for supporting a label roll composed of a composite label web having labels releasably adhered to a carrier web, a platen, a print head cooperable with the platen to print on a label at a printing position between the print head and the platen, means for delaminating printed labels from the carrier web, means for applying printed labels, means for mounting the print head for movement toward and away from the platen, means for advancing the composite label web while the print head is moving toward the platen and while the print head is moving away from the platen, wherein the advancing means includes a manually operable actuator disposed at the handle, and means for preventing operation of the advancing means when the print head is nearing cooperation with the platen.

2. A hand-held labeler for printing and applying pressure sensitive labels, comprising: a housing having a manually graspable handle, means on the housing for supporting a label roll composed of a composite label web having labels releasably adhered to a carrier web, a platen, a print head cooperable with the platen to print on a label at a printing position between the print head and the platen, a pair of spaced first and second racks connected to the print head, means for mounting the print head and the racks for straight line movement toward and away from the platen, a manually operable actuator disposed at the handle, a feed wheel engageable with the carrier web, means coupled to the first rack for advancing the feed wheel while the print head is moving toward the platen, and means coupled to the actuator and to the second rack for advancing the feed wheel while the print head is moving away from the platen.

3. A hand-held labeler as defined in claim 2, wherein the means coupled to the first rack for advancing the feed wheel includes a set of gears, wherein one of the gears meshes with the first rack.

4. A hand-held labeler as defined in claim 2, wherein the means coupled to the first rack for advancing the feed wheel includes gearing meshing with the first rack and a pawl and ratchet mechanism driven by the gearing and coupled to the feed wheel.

5. A hand-held labeler for printing and applying pressure sensitive labels, comprising: a housing having a manually graspable handle, means on the housing for supporting a label roll composed of a composite label web having labels releasably adhered to a carrier web, a platen, a print head cooperable without he platen to print on a label at a printing position between the print head and the platen, a pair of spaced first and second racks connected to the print head, means for mounting the print head and the racks for straight line movement toward and away from the platen, a manually operable actuator disposed at the handle, a feed wheel engageable with the carrier web, means coupled to the first rack and to the actuator for advancing the feed wheel while the print head is moving toward the platen, and means coupled to the second rack for advancing the feed wheel while the print head is moving away from the platen.

6. A hand-held labeler as defined in claim 5, wherein the means coupled to the first rack and to the actuator for advancing the feed wheel includes a set of gears in mesh with the first rack.

7. A hand-held labeler as defined in claim 5, wherein the means coupled to the first rack and to the actuator for advancing the feed wheel includes gearing meshing with the first rack and a pawl and ratchet mechanism driven by the gearing and coupled to the feed wheel.

8. A hand-held labeler for printing and applying pressure sensitive labels, comprising: a housing having a manually graspable handle, means on the housing for supporting a label roll composed of a composite label web having labels releasably adhered to a carrier web, a platen, a print head cooperable with the platen to print on a label at a printing position between the print head and the platen, means for delaminating printed labels from the carrier web, means for applying printed labels, means for mounting the print head for movement toward and away from the platen, a feed wheel engageable with the carrier web, a manually operable actuator disposed at the handle, means coupled to the actuator and to the print head for moving the print head toward and away from the platen and for advancing the feed wheel during a printing cycle, wherein the means for moving the print head and for advancing the feed wheel includes a pawl and ratchet mechanism and a one-way clutch, the one-way clutch being operable to advance the feed wheel during one part of the printing cycle and the pawl and ratchet mechanism being operable to advance the feed wheel during another part of the printing cycle.

9. A hand-held labeler for printing and applying pressure sensitive labels, comprising: a housing having a manually graspable handle, means on the housing for supporting a label roll composed of a composite label web having labels releasably adhered to a carrier web, a platen, a print head cooperable with the platen to print on a label at a printing position between the print head and the platen, means for delaminating printed labels from the carrier web, means for mounting the print head for movement toward and away from the platen, means for advancing the composite web while the print head is moving toward the platen and while the print head is moving away from the platen, wherein the advancing means includes an actuator disposed at the handle and actutable by the user and a pawl and ratchet mechanism, and a cam for disabling the pawl and ratchet mechanism when the print head is nearing cooperation with the platen.

10. A hand-held labeler for printing and applying pressure sensitive labels, comprising: a housing having a manually graspable handle, means on the housing for supporting a label roll composed of a composite label web having labels releasably adhered to a carrier web, a platen, a print head cooperable with the platen to print on a label at a printing position between the print head and the platen, means for delaminating printed labels from the carrier web, means for applying printed labels, a pair of spaced first and secnd racks connected to the print head, means for mounting the print head and the racks for straight line movement toward or away from the platen, a manually operable actuator disposed at the handle, a pair of first and second gear sections on the actuator, a pair of first and second gears, the first gear meshing with the first gear section and the first rack and the second gear meshing with the second gear section and the second rack, a feed wheel engageable with the carrier web for advancing the composite web to bring labels to the printing position and into label applying relationship with the label applying means, gearing driven by the first rack, a pawl and ratchet mechanism driven by the gearing and coupled to the feed wheel, and a cam for releasing the pawl from the ratchet before the print head cooperates with the platen.

11. A hand-held labeler for printing and applying pressure sensitive labels, comprising: a housing having a manually graspable handle, means on the housing for supporting a label roll composed of a composite label web having labels releasably adhered to a carrier web, a platen, a print head cooperable with the platen to print on a label at a printing position between the print head and the platen, means for delaminating printed labels from the carrier web, means for applying printed labels, means for mounting the print head for movement toward and away from the platen, a feed wheel for advancing the composite web, a manually operable actuator disposed at the handle, a drive connection between the actuator, the print head and the feed wheel to move the print head into and out of printing cooperation with the platen and to move the feed wheel while the print head is moving into printing cooperation with the platen and while the print head is moving out of printing cooperation with the platen, the drive connection including a one-way clutch operative to move the feed wheel when the print head is moving into printing cooperation with the platen and a pawl and ratchet mechanism operative to move the feed wheel when the print head is moving out of printing cooperation with the platen.

12. A hand-held labeler for printing and applying pressure sensitive labels, comprising: a housing having a manually graspable handle, means on the housing for supporting a label roll composed of a composite label web having labels releasably adhered to a carrier web, a platen, a print head cooperable with the platen to print on a label at a printing position between the print head and the platen, means for delaminating printed labels from the carrier web, means for applying printed labels, means for mounting the print head for movement toward and away from the platen, a feed wheel for advancing the composite web, a manually operable actuator disposed at the handle, a drive connection between the actuator, the print head and the feed wheel to move the print head into and out of printing cooperation with the platen and to move the feed wheel while the print head is moving into printing cooperation with the platen and while the print head is moving out of printing cooperation with the platen, the drive connection including a one-way clutch operative to move the feed wheel when the print head is moving into printing cooperation with the platen and a pawl and ratchet mechanism operative to move the feed wheel when the print head is moving out of printing cooperation with the platen.

13. A hand-held labeler for printing and applying pressure sensitive labels, comprising: a housing having a manually graspable handle, means on the housing for supporting a label roll composed of a composite label web having labels releasably adhered to a carrier web, a platen, a print head cooperable with the platen to print on label at a printing position between the print head and the platen, means for delaminating printed labels from the carrier web, means for applying printed labels, means for mounting the print head for straight line movement toward and away from the platen, means for advancing the composite web while the print head is moving toward the platen and while the print head is moving away from the platen, wherein the advancing means includes an actuator disposed at the handle and actuatable by the user.

14. A hand-held labelers for applying pressure sensitive labels, comprising: a housing having a manually graspable handle, means on the housing for supporting a label roll composed of a composite label web having labels releasably adhered to a carrier web, means for delaminating labels from the carrier web, means for applying labels, a feed wheel for advancing the composite web, a manually operable actuator disposed at the handle and movable in one direction and in a direction opposite to the one direction, a drive connection between the actuator and the feed wheel to move the feed wheel while the actuator is moving in the one direction and in the opposite direction, the drive connection including a one-way clutch operative to move the feed wheel when the actuator is moving in the one direction and a pawl. and ratchet mechanism operative to move the feed wheel when the actuator is moving in the opposite direction.

15. A hand-held labeler for applying pressure sensitive labels during a cycle, comprising: a housing having a manually graspable handle, means on the housing for supporting a label roll composed of a composite label web having labels releasably adhered to a carrier web, means for delaminating labels from the carrier web, means for applying labels, a feed wheel engageable with the carrier web, a manually operable actuator disposed at the handle, means coupled to the actuator for advancing the feed wheel, wherein the means for advancing the feed wheel includes a pawl and ratchet mechanism and a one-way clutch, the one-way clutch being operable to advance the feed wheel during one part of the cycle and the one-way clutch being operable to advance the feed wheel during another part of the cycle.

16. A hand-held labeler for applying pressure sensitive labels, comprising: a housing having a manually graspable handle, the housing being capable of supporting a label roll composed of a composite label web having labels releasably adhered to a carrier web, a delaminator for delaminating printed labels from the carrier web, an applicator head for applying printed labels, the applicator head including a flexible resilient applicator body projecting outwardly from the housing and further including an applicator roll mounted on the applicator body in spaced relation to the delaminator, and the applicator body resiliently deflecting upon impact.

17. A hand-held labeler for applying pressure sensitive labels, comprising: a housing having a manually graspable handle, means on the housing for supporting a label roll composed of a composite label web having labels releasably adhered to a carrier web, means for delaminating printed labels from the carrier web, an applicator head for applying printed labels, means for advancing the composite label web to essentially entirely delaminate a label and to bring the delaminated label into label applying relation to the applicator head, and wherein the applicator head includes a flexible resilient applicator body projecting from the housing, the applicator body resiliently deflecting upon impact, and further includes an applicator roll on the applicator body and spaced from the delaminator.

18. A hand-held labeler for printing and applying pressure sensitive labels, comprising: a housing having a manually graspable handle, the housing being capable of supporting a label roll composed of a composite label web having labels releasably adhered to a carrier web, a platen, a print head cooperable with the platen to print on a label at a printing position between the print head and the platen, a delaminator for delaminating printed labels from the carrier web, an applicator for applying printed labels, a feed wheel, the feed wheel advancing the composite label web while the print head is moving toward and into cooperation with the platen and also while the print head is moving away from and out of cooperation with the platen, a manually operable actuator disposed at the handle for operating the feed wheel, and a cam surface preventing operation of the feed wheel when the print head is nearing cooperation with the platen.

19. A hand-held labeler for printing and applying pressure sensitive labels, comprising: a housing having a manually graspable handle, the housing being capable of supporting a label roll composed of a composite label web having labels releasably adhered to a carrier web, a platen, a print head cooperable with the platen to print on a label at a printing position between the print head and the platen, a pair of spaced first and second racks connected to the print head, the print head and the racks being mounted for straight line movement so that the print head moves toward and away from the platen, a manually operable actuator disposed at the handle, a feed wheel engageable with the carrier web, a set of gears, the first rack being coupled to the feed wheel while the print head is moving toward the platen, wherein one of the gears meshes with the first rack, and the second rack coupling being coupled the feed wheel and advancing the feed wheel while the print head is moving away from the platen.

20. A hand-held labeler for printing and applying pressure sensitive labels, comprising: a housing having a manually graspable handle, the housing being capable of supporting a label roll composed of a composite label web having labels releasably adhered to a carrier web, a platen, a print head cooperable with the platen to print on a label at a printing position between the print head and the platen, a delaminator for delaminating printed labels from the carrier web, an applicator for applying printed labels, the print head being mounted for movement toward and away from the platen, a feed wheel engageable with the carrier web, a manually operable actuator disposed at the handle, the actuator being operable to move the print head toward and away from the platen during a printing cycle, a pawl and ratchet mechanism, a one-way clutch, the one-way clutch advancing the feed wheel during one part of the printing cycle and the pawl and ratchet mechanism advancing the feed wheel during another part of the printing cycle.

21. A hand-held labeler for printing and applying pressure sensitive labels, comprising: a housing having a manually graspable handle, the housing being capable of supporting a label roll composed of a composite label web having labels releasably adhered to a carrier web, a platen, a print head cooperable with the platen to print on a label at a printing position between the print head and the platen, a delaminator for delaminating printed labels from the carrier web, the print head being mounted for movement toward and into cooperation with the platen and away from and out of cooperation with the platen, a feed wheel, the feed wheel advancing the composite web while the print head is moving toward the platen and while the print head is moving away from the platen, a pawl and ratchet mechanism, and a cam surface the cam surface disabling the pawl and ratchet mechanism when the print head is nearing cooperation with the platen.

22. A hand-held labeler for printing and applying pressure sensitive labels, comprising: a housing having a manually graspable handle, the housing being capable of supporting a label roll composed of a composite label web having labels releasably adhered to a carrier web, a platen, a print head cooperable with the platen to print on a label at a printing position between the print head and the platen, a delaminator for delaminating printed labels from the carrier web, an applicator for applying printed labels, a pair of spaced first and second racks connected to the print head, the print head and a racks being mounted for straight line movement, a manually operable actuator disposed at the handle, a pair of first and second gear sections on the actuator, a pair of first and second gears, the first gear meshing with the first gear section and the first rack and the second gear meshing with the second gear section and the second rack, a feed wheel engageable with the carrier web for advancing the composite web to bring labels to the printing position and into label applying relationship with the applicator, gearing driven by the first rack, a pawl and ratchet mechanism driven by the gearing and coupled to the feed wheel, and a cam surface, the cam surface releasing the pawl from the ratchet before the print head moves into cooperation with the platen.

23. A hand-held labeler for printing and applying pressure sensitive labels, comprising: a housing having a manually graspable handle, the housing being capable of supporting a label roll composed of a composite label web having labels releasably adhered to a carrier web, a platen, print head cooperable with the platen to print on a label at a printing position between the print head and the platen, a delaminator for delaminating printed labels from the carrier web, an applicator for applying printed labels, the print head being mounted for movement toward and away from the platen, a feed wheel for advancing the composite web, a manually operable actuator disposed at the handle, a drive connection between the actuator, the print head and the feed wheel to move the print head into and out of printing cooperation with the platen and to move the feed wheel while the print head is moving into printing cooperation with the platen and while the print head is moving out of printing cooperation with the platen, the drive connection including a one-way clutch moving the feed wheel when the print head is moving into printing cooperation with the platen and the pawl and ratchet mechanism moving the feed wheel when the print head is moving out of printing cooperation with the platen.

24. A hand-held labeler for printing and applying pressure sensitive labels, comprising: a housing having a manually graspable handle, the housing being capable of supporting a label roll composed of a composite label web having labels releasably adhered to a carrier web, a platen, a print head movable relative to the platen to print on a label at a printing position between the print head and the platen, a delaminator for delaminating printed labels from the carrier web, an applicator for applying printed labels, the print head being mounted for movement toward and away from the platen, a feed wheel for advancing the composite web, a manually operable actuator disposed at the handle, a drive connection between the actuator, the print head and the feed wheel, the drive connection including a one-way clutch moving the feed wheel when the print head is moving into the printing position with respect to the platen, and a pawl and ratchet mechanism moving the feed wheel when the print head is moving out of the printing position with respect to the platen.

25. A hand-held labeler for applying pressure sensitive labels, comprising: a housing having a manually graspable handle, the housing being capable of supporting label roll composed of a composite label web having labels releasably adhered to a carrier web, a delaminator for delaminating labels from the carrier web, an applicator for applying labels, a feed wheel for advancing the composite web, a manually operable actuator disposed at the handle and movable in one direction and in a direction opposite to the one direction, a drive connection between the actuator and the feed wheel operable while the actuator is moving in the one direction and in the opposite direction, the drive connection including a one-way clutch moving the feed wheel when the actuator is moving in the one direction and a pawl and ratchet mechanism moving the feed wheel when the actuator is moving in the opposite direction.

* * * * *

UNITED STATES PATENT AND TRADEMARK OFFICE

CERTIFICATE OF CORRECTION

PATENT NO. : 5,875,715

DATED : March 2, 1999

INVENTOR(S) : Paul H. Hamisch, Jr. and James A. Makley

It is certified that error appears in the above-indentified patent and that said Letters Patent is hereby corrected as shown below:

Column 2, line 62, "I 19" should be --119--. Column 6, line 26, "without he" should be --with the--. Column 9, line 53, "being coupled" should be omitted.

Signed and Sealed this

Twenty-eighth Day of March, 2000

*Attest:*

Q. TODD DICKINSON

*Attesting Officer*

*Commissioner of Patents and Trademarks*